United States Patent [19]

Van Brunt et al.

[11] Patent Number: 4,927,013

[45] Date of Patent: May 22, 1990

[54] PACKAGE FOR STORING AND REMIXING TWO MATERIALS

[75] Inventors: Nicholas Van Brunt; Jeffrey C. Robertson, both of Rochester; Daniel Homa, Spencerport, all of N.Y.

[73] Assignee: Eastman Kodak Company, Rochester, N.Y.

[21] Appl. No.: 336,986

[22] Filed: Apr. 12, 1989

[51] Int. Cl.[5] ..... B65D 25/08; B65D 81/32

[52] U.S. Cl. ..... 206/221; 206/219; 215/DIG. 8

[58] Field of Search ..... 206/219, 220, 221, 222; 215/6, DIG. 8

[56] References Cited

U.S. PATENT DOCUMENTS

| | | | |
|---|---|---|---|
| 2,793,776 | 5/1957 | Lipari | 206/221 |
| 3,330,281 | 7/1967 | Visser | 206/221 |
| 3,842,836 | 10/1974 | Ogle | 206/221 |
| 3,924,741 | 12/1975 | Kachur et al. | 206/221 |
| 4,203,517 | 5/1980 | Hildebrandt et al. | 206/221 |
| 4,479,578 | 10/1984 | Brignola et al. | 206/221 |
| 4,518,386 | 5/1985 | Tartaglia | 206/219 |
| 4,727,985 | 3/1988 | McNeirney et al. | 206/221 |

*Primary Examiner*—Paul T. Sewell
*Assistant Examiner*—Jacob Ackun, Jr.
*Attorney, Agent, or Firm*—Dana M. Schmidt

[57] ABSTRACT

There is described a package and method of packaging that provide, in inexpensive form, means for adding accurate amounts of one material to another. The package, which can come as a kit to be added to a lyophilizing bottle and stopper, features a portion that is added to the bottle outlet to confine the material that is to be stored separate from the contents of the bottle. That portion includes a plunger preferably constructed to provide a dual function: that of sealing the stopper against the bottle outlet, and of permanently attaching to the stopper to remove it from the bottle when the plunger is moved within the upper portion. Because of its hollow configuration, the plunger can be used to pour off the resulting mixture.

7 Claims, 5 Drawing Sheets

PACKAGE FOR STORING AND REMIXING TWO MATERIALS

FIELD OF THE INVENTION

The invention relates to a package and method for storing two materials separate from each other, the package and method allowing the materials to be combined accurately after storage for subsequent removal from the package.

BACKGROUND OF THE INVENTION

Reconstitution of lyophilized (freeze dried) material is often difficult to do accurately and safely. If the amount or quality of the reconstituting liquid is questionable, then the concentration or efficacy, respectively, of the reconstitution is likely to be unsatisfactory. As an example, milk products are notorious for mishandling during reconstitution in third world countries, due either to inaccuracies in the amount of liquid used or to contaminants being present. Thus, when pharmaceuticals or food products are being reconstitituted, it has been the practice to require the use of carefully trained personnel. The same has been true in other uses of lyophilized material, such as calibrators and controls.

Therefore, there has been a need, prior to this invention, to develop packaging of lyophilized material that will allow reconstitution to occur safely and accurately, without the use of skilled personnel. Such development has been hindered by the known fact that elastomeric stoppers usually used to seal a bottle of lyophilized material, are susceptible to degradation if stored in contact with the liquid that is to eventually reconstitute the dried material. Yet another problem with such stoppers has been that a mere friction-fit of the stopper in a bottle usually does not provide an adequate seal to keep lyophilized material and liquid separated. Additional crimping has been needed. Most lyophilates do not store well if they become wetted, because they deteriorate when stored in this condition.

Thus, considerable problems have occurred prior to this invention when elastomeric stoppers were used in lyophilate packaging. This has been unfortunate, since the elastomeric stoppers have the advantage of being relatively inexpensive, compared to other barriers that can be used.

Some attempts have been made heretofore to provide lyophilate packaging, particularly that which avoids the use of elastomeric stoppers. Examples are described in U.S. Pat. Nos. 3,924,741 and 4,203,517. However, regarding the container of the '741 patent, the pieces involved require complex shaping and molding that render the device quite expensive. Furthermore, the construction of plunger 11 in that container renders it difficult to lyophilize the material while it is in the plunger, so that it must be lyophilized elsewhere. Transfer of the lyophilized powder to the plunger as a separate step is too complicated to do under dry, evacuated conditions, the absence of which risk contaminating the lyophilate with moisture or bacteria. Regarding the package of the '517 patent, the non elastomeric stopper 29 that is used becomes a loose part within the reconstituted liquid, an undesirable feature during pour-off. Thus, these previous attempts tend to either sacrifice the integrity of the lyophilate, or create problems during pour-off of the reconstituted liquid.

SUMMARY OF THE INVENTION

We have solved the above problems by a preassembled package that uses an elastomeric stopper and a plunger, the plunger providing both the function of maintaining the seal of the stopper between the two separated materials, and also of removing the stopper from its barrier position without losing it into the solution. Such a package allows the manufacturer to supply accurate and sterile amounts of reconstituting liquid, in an inexpensive way.

More specifically, in accord with one aspect of the invention, there is provided a package containing a first material in a first portion and a second material in a second portion, the materials requiring complete separation during storage, each of the first and second portions having an outlet positioned to allow either of the materials to flow to the other material, an elastomeric stopper means being temporarily disposed in one of the outlets for sealing off flow of either material to the other material. The package is improved in that one of the portions includes a plunger extending from and movably mounted in the one portion, the plunger including (a) means for permanently Joining the stopper means to the plunger, (b) means for pushing the stopper means against the one outlet to seal the stopper means against the one outlet, and (c) means for moving the plunger relative to the one portion; whereby the plunger acts both as a positive crimp to prevent material leakage past the stopper means during storage, and as the means for moving the stopper means out of the outlet when mixing of the materials is desired.

In accord with another aspect of the invention, there is provided a kit for sealing a lyophilizing bottle having an opening using an elastomeric stopper for insertion into the bottle to close the opening, the kit comprising (a) a sleeve constructed to fit around the stopper and the opening. (b) a plunger movably mounted within the sleeve and extending therefrom, the plunger having opposite ends, one of the ends including means for joining the stopper to the plunger and the other end including a removable closure member, the one stopper end further including means for pressing the compressible stopper against the opening to seal it, and (c) means for moving the plunger with a mechanical advantage down through the sleeve to contact the compressible stopper with the pressing means.

In accord with yet another aspect of the invention, there is provided a method for supplying lyophilized material in a form that is automatically and accurately reconstitutable, comprising the steps of: (a) lyophilizing the material in a package portion having an outlet and an elastomeric stopper for the outlet, (b) inserting the stopper fully into the outlet after step (a) to temporarily seal the outlet, (c) assembling a sleeve and a plunger movable in the sleeve, around the outlet and the stopper so that the plunger presses the stopper against the outlet to insure the seal, the plunger having opposite ends, one of the ends including means for joining the stopper to the plunger and the other end including a removable closure member, (d) removing the closure member and adding an exact, predetermined amount of sterile reconstitution liquid to the plunger, and (e) closing and sealing the plunger with the closure member.

Thus, it is an advantageous feature of the invention that prepackaged reconstitution liquid is provided for a lyophilized material in an inexpensive but accurate and sterile form.

It is a further advantageous feature of the invention that a packaging of two separated materials for automatic remixing can be done without producing a loose stopper, and/or a stopper that can be leached by the liquid.

Other advantageous features will become apparent upon reference to the following "Detailed Description of the Preferred Embodiments" when read in light of the attached drawings.

DESCRIPTION OF THE PREFERRED EMBODIMENTS

This invention is described by reference to the preferred embodiments wherein one of the two separated materials is a lyophilized material and the other the liquid to be used to reconstitute it, to make a calibrator or control for a clinical analyzer. Thus, the preferred container for the lyophilate is a glass bottle of any convenient size, as is well known, due to the difficulty in lyophilizing liquids effectively in a plastic container. In addition, the invention is useful to store in a separated condition, any two materials that are to be mixed on demand, be they both in powder form, both liquids, or only one in a liquid form. For this reason, it is not essential that one of the package portions be a glass bottle.

Figure 1:
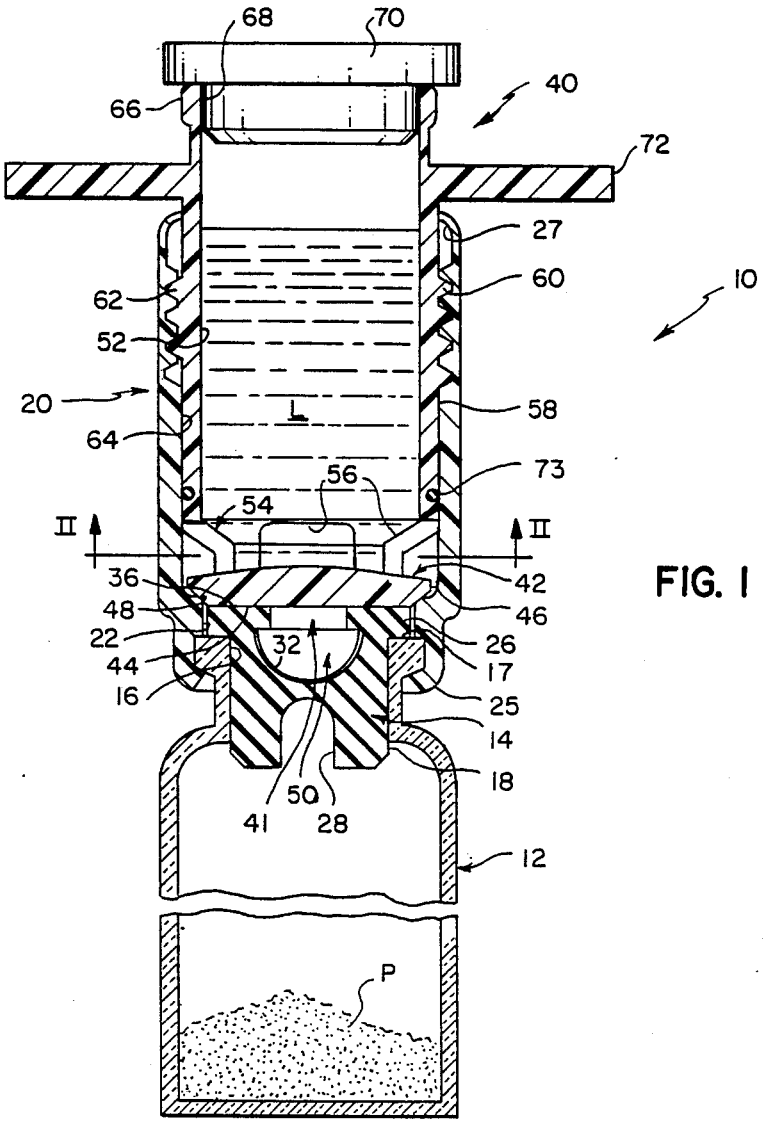
FIG. 1 is a fragmentary elevational view in section of a package constructed in accordance with the invention.

A package 10 of the invention comprises, FIG. 1, a first portion 12 that is preferably a glass bottle, a second, upper portion that is preferably a cylindrical sleeve 20 joined to the first portion and a plunger 40, and a stopper 14. Both portions 12 and 20 have an outlet or opening 16 and 22, respectively, the two portions being Joined together with outlets 16 and 22 adjacent. In addition, portion 20 has a second outlet 24 FIG. 3*b* through which plunger 40 protrudes. Outlet 16 has a top surface 17 FIG. 1 against which stopper 14 is pushed by plunger 40. Outlets 22 and 24 are preferably heat crimped around the member fitted inside—that is, outlet 22 is crimped at 25 around bottle 12, and outlet 24 is crimped at 27 around plunger 40.

Most preferably, stopper 14 is of conventional elastomeric construction with a bottom portion 18 and a top portion 26. Bottom portion 18 has a groove 28 extending preferably all the way through, and a ridge 30 extending around the circumference of portion 18, FIG. 3A, to cooperate with groove 28 as is described hereinafter. In top portion 26, a recess 32 is formed with a larger interior diameter "x", FIG. 3A, than the hole 34 leading to the recess, to cooperate with an engaging means in the plunger. Such stoppers are conventionally formed of elastomers, for example, butyl rubber, which tend to degrade (such as by leaching out constituents) and produce particulates when stored in liquid for a period of time.

When assembled as shown in FIG. 1, stopper 14 has top portion 26 resting on top surface 17 of outlet 16 of bottle 12, and bottom portion 18 is force fit into outlet 16. This is adequate to provide a temporary seal that keeps moisture from prematurely re wetting lyophilate P residing at the bottom of bottle 12, but not adequate for a long-term seal particularly if liquid is to be stored above the stopper.

To provide a more permanent seal of stopper 14 in outlet 16, plunger 40 is provided at one of its ends 41 with a sealing means 42 that acts as a second stopper in outlet 22 of top portion 20 of package 10. Means 42 is mounted at one of the opposing ends of plunger 40, and is a disk, for example manufactured from polypropylene, having a surface 44 to press against stopper 14, thus completing its seal in outlet 16. Surface 44 terminates at a circumferential surface 46 shaped with a chamfer to seal on a shoulder 48 formed in sleeve 20 adjacent outlet 22. The sealing of surface 46 against shoulder 48 is effective to keep liquid L (preferably distilled water with or without additives) from passing shoulder 48 and contacting stopper 14.

Projecting downwardly from sealing means 42 of plunger 40 is a stud 50, shaped to permanently attach stopper 14 to the plunger, once stud 50 engages recess 32. Thus, stud 50 preferably has a nail-head shape that is roughly congruent with the shape of recess 32. Other shapes of engagement are also useful.

Figure 2:
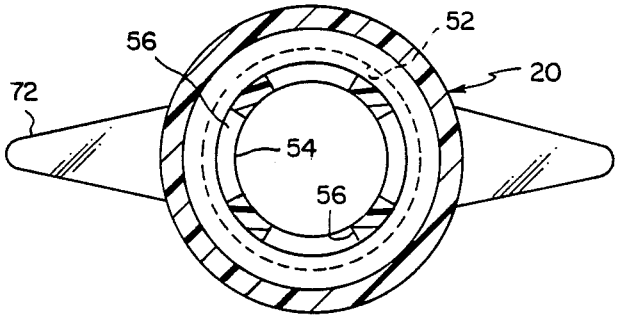
FIG. 2 is a section view taken generally along the line II—II of FIG. 1.

Both disk 42 and stud 50 are attached to a generally cylindrical sidewall 52 of plunger 40, that necks down at portion 54 to attach to disk 42, FIGS. 1 and 2. Several openings 56 are formed at portion 54, to allow liquid L to pour out when the stoppers are removed from outlets 16 and 22.

The exterior surface 58 of sidewall 52 is provided over at least a portion of its circumference, with a male thread 60. This thread is shaped to engage a matching female thread 62 on the inside surface 64 of sleeve 20.

To allow removal of reconstituted liquid, plunger 40 is preferably hollow and has an end 66 opposite to end 41, that has an outlet 68. A removable closure member, such as stopper 70, fits within that end, to seal liquid L inside. Adjacent to end 66, exterior handle means 72 are provided to allow manual movement of plunger 40 relative to sleeve 20, preferably by rotation so that plunger 40 traverses up and down within the sleeve.

To seal plunger 40 within sleeve 20 adjacent the necked—in portion 54, an O-ring 73 is placed around the circumference of surface 58. Any elastomeric material is useful for O-ring 73, for example, "Santoprene" TM. The O-ring bears against inside surface 64 of sleeve 20, and can be co-injected for inexpensive manufacturing.

Figure 3A:
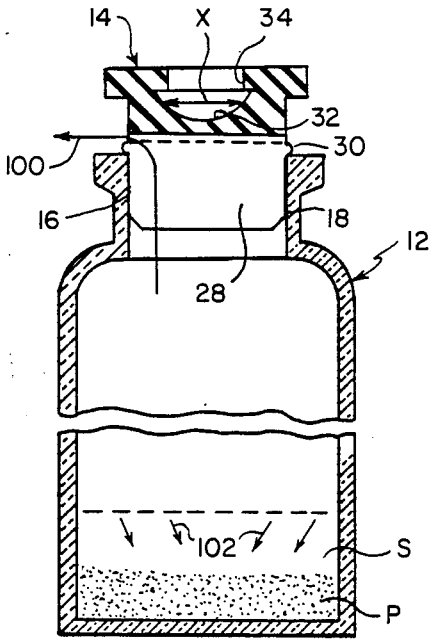
FIG. 3A–3C are elevational views of the parts of the package, similar to that of FIG. 1 but illustrating the steps in the assembly.
Figure 3B:
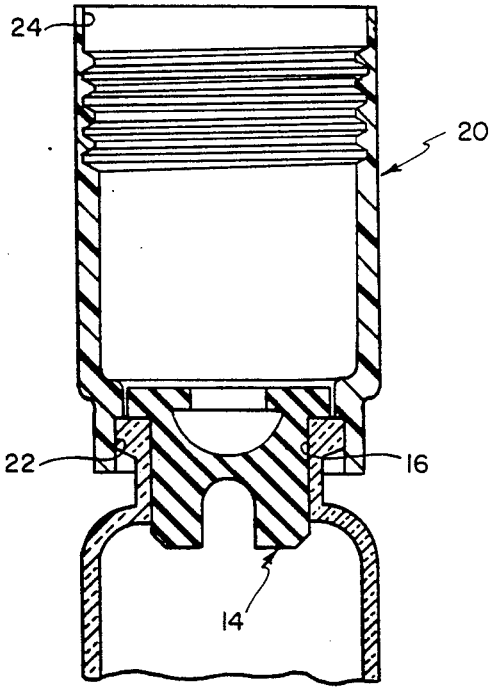
Figure 3C:
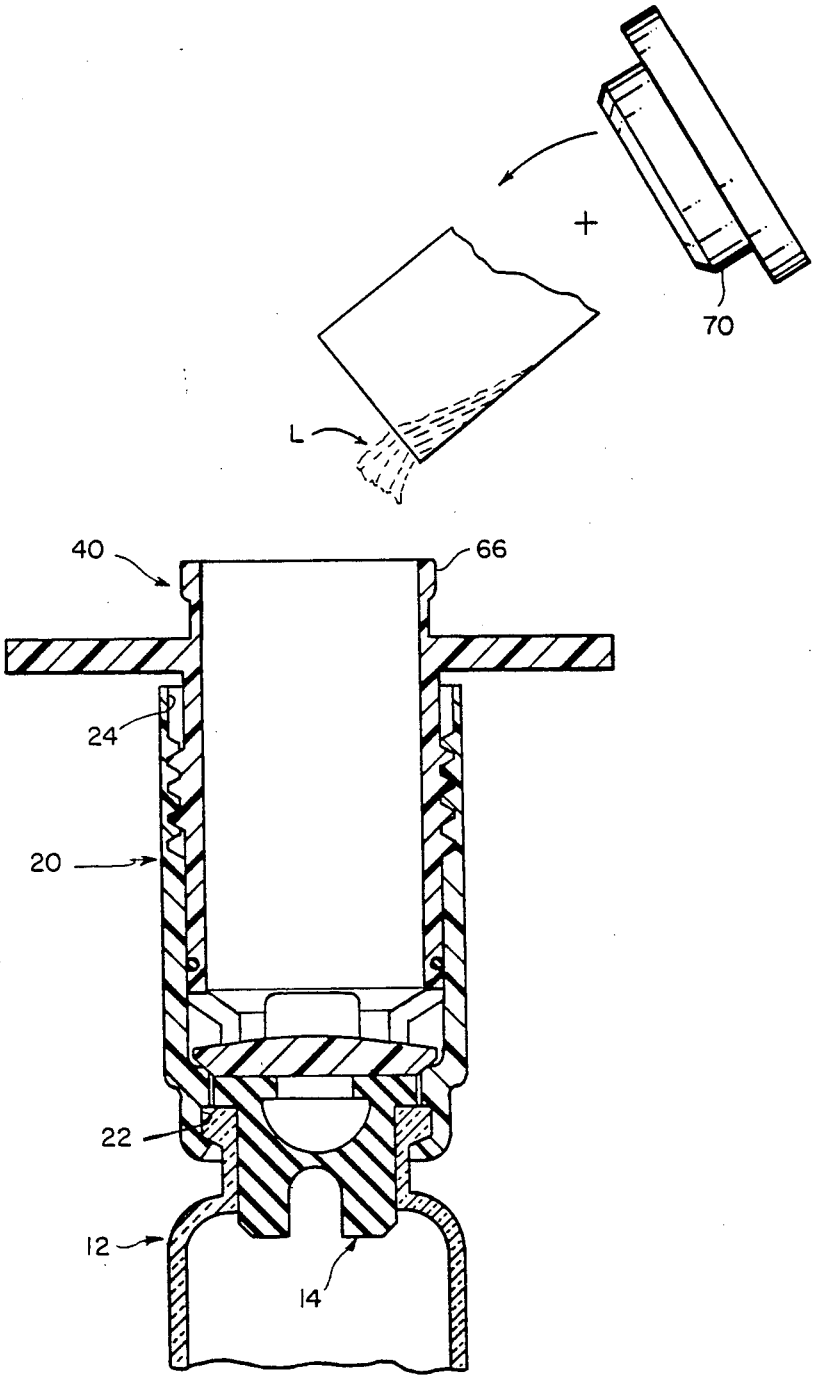

Referring to FIGS. 3A–3C, assembly of the package proceeds as follows:

Bottle 12 initially contains a solution S in which dried material P is dissolved or dispersed, FIG. 3A. Stopper 14 is placed only partway into outlet 16, so that it rests on ridge 30 with groove 28 in air communication with the exterior. This assembly is placed into a freeze-drier that preferably includes means for freezing and for pulling a vacuum. Lyophilization occurs as symbolized by "$-\Delta P$", arrow 100. A solid cake then forms from solution S, arrows 102. Immediately on, or prior to, cessation of the vacuum, stopper 14 is pushed all the way into outlet 16, FIG. 3B.

Thereafter, sleeve 20 is press fitted into place over outlet 16 of bottle 12, with outlets 22 and 24 uncrimped. Outlet 22 is then heat crimped to take on the shape 25 as shown in FIG. 1. Plunger 40 is then screwed into sleeve 20, FIG. 3C, using the screw threads. Outlet 24 is, thereafter, heat crimped (not shown) to take on the shape 27, FIG. 1. Plunger 40 is advanced sufficiently within sleeve 20 to force disk 42 to seal against both stopper 14 and shoulder 48 of sleeve 20. Next, reconstituting liquid L is added in precise amounts, while still sterile, and closure member 70 is then inserted into end 66 of plunger 40. The packaging is now complete.

It will be apparent from the preceding description that the packaging parts, due to their straightforward, simple shape, are relatively inexpensive to manufacture and assemble. That is, both sleeve 20 and plunger 40 are generally cylindrical tubes with appropriate modifications at their ends and on certain surfaces. These packaging parts can be supplied as a kit of parts to those who have standard bottles to do lyophilization. In some cases, the stopper 14 can be omitted from the kit if it is already present with the bottle.

To allow liquid L and solid material P to remix, thus reconstituting the solution of the material, plunger 40 is simply caused to withdraw out of sleeve 20, by rotating handle means 72 and the plunger, FIG. 1. This retraction of plunger 40 causes disk 42 to unseat from shoulder 48 and stud 50 to pull stopper 14 out of outlet 16. Liquid L then pours out (not shown) through openings 56 and down into bottle 12. The entire package is agitated so that the newly reformed solution wets all interior surfaces of bottle 12 and the upper portion of the package, including sleeve 20 and plunger 40. This insures that the proper concentration occurs in the solution. Thereafter, closure member 70 can be removed and the entire solution poured out through outlet 68. Because stopper 14 is captured by plunger 40, there is no loose part floating in the solution. Furthermore, there is no prolonged exposure of the stopper to the solution to cause leaching and contamination of the solution.

Figure 4:
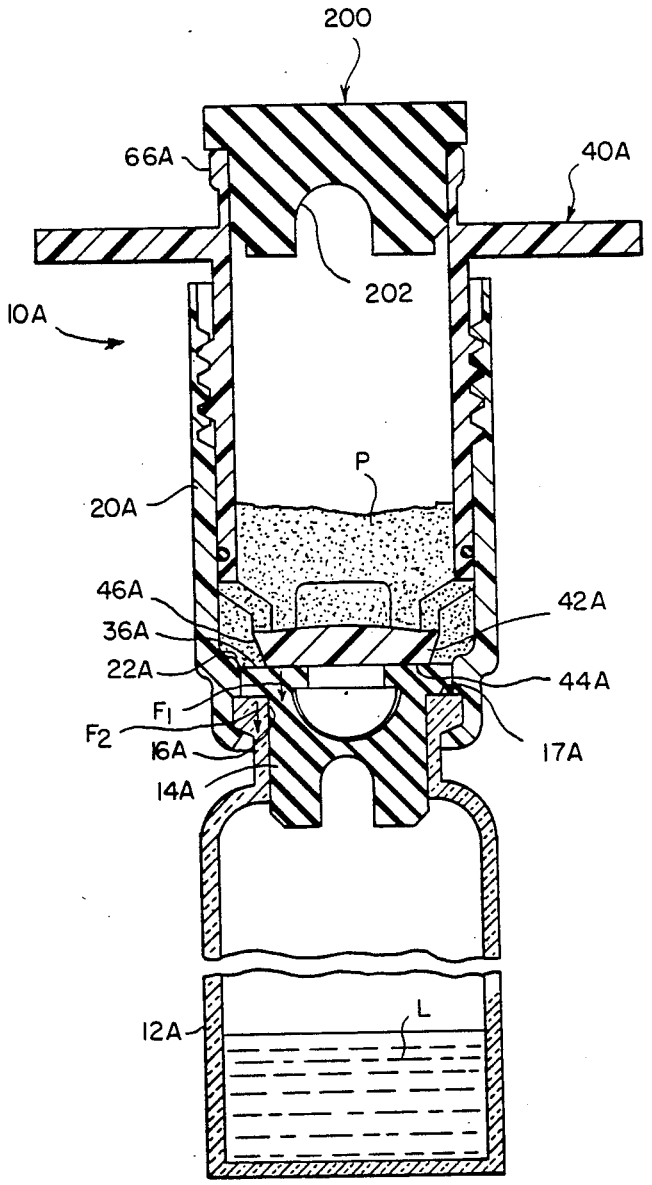
FIG. 4 is a fragmentary elevational view similar to that of FIG. 1, but illustrating an alternative embodiment.

It is not essential that the upper portion (containing the plunger) be used to store the liquid, for powder stored in the bottle below. Instead, FIG. 4, the powder :an be in the plunger and the reconstituting liquid be stored in the bottle below. Parts similar to those previously described bear the same reference numeral to which the distinguishing suffix "A" has been appended.

Thus, package 10A comprises bottle portion 12A and upper portion featuring sleeve 20A and plunger 40A as before, effective to both seal stopper 14A in outlet 16A of portion 12A, and to remove that stopper later, as described heretofore. However, the material stored in sleeve 20A and plunger 40A is powder, rather than liquid, and disk 42A does not seal across outlet 22A of sleeve 20A. Instead, circumference surface 46A of disk 42A falls short of contacting sleeve 20A. Nevertheless, surface 44A is effective to push, arrow $F_1$, top surface 36A of stopper 14A against the top surface 17A of outlet 16A, arrow $F_2$, thereby pushing the stopper an amount sufficient to make the stopper seal at outlet 16A. By comparison, if stopper 14A were to lack the lip portion that presses against top surface 17A of outlet 16A, so as to be only friction fit into outlet 16A, then plunger 40A through disk 42A would not be effective in crimping the stopper against outlet 16A. That is, the pushing force (arrow $F_1$) would have essentially no component that would be perpendicular to the inside cylindrical surface of outlet 16A.

Circumference surface 46A need not seal in outlet 22A for several reasons. One is that there is no liquid stored in the upper portion to draw particles out of stopper 14A. Even if there were, that is, if material P were instead a stored liquid, the exposed portion of surface 36A of the stopper can be rendered resistant to the liquid simply by coating it with Teflon. Thus, only one stopper is needed at the joined outlets 16A and 22A, namely stopper 14A.

Material P can be formed as a lyophilate in sleeve 20A and plunger 40A by substituting a stopper 200 at end 66A of plunger 40A, for the closure member, where stopper 200 is a duplicate of stopper 14A, including the use of groove 202 to allow air flow out when stopper 200 is only partially inserted. That is, the entire package 10A can be inserted into the freeze-drying apparatus, as the seal of stopper 14A is effective to protect liquid L from being lyophilized.

Figure 5:
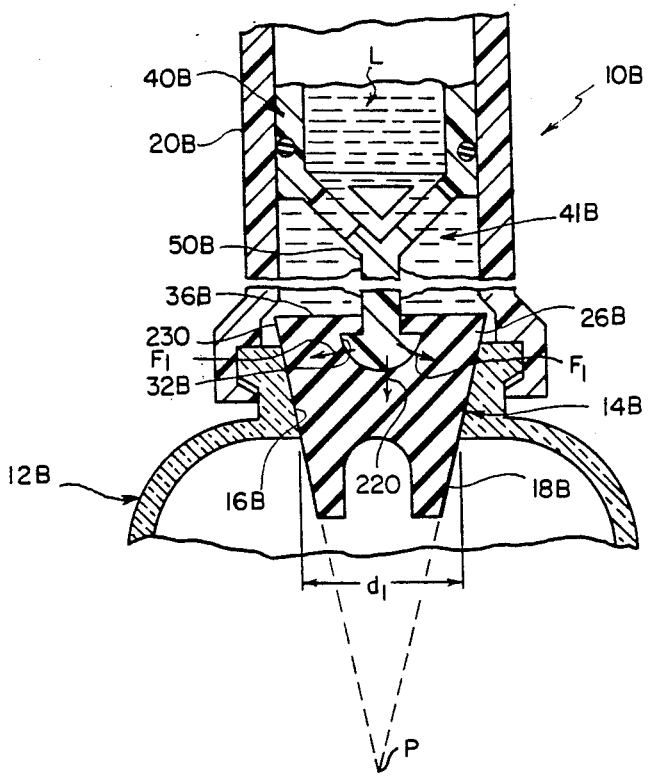
FIG. 5 is a fragmentary elevational view similar to that of FIG. 1, but illustrating yet another alternative embodiment.
Figure 6:
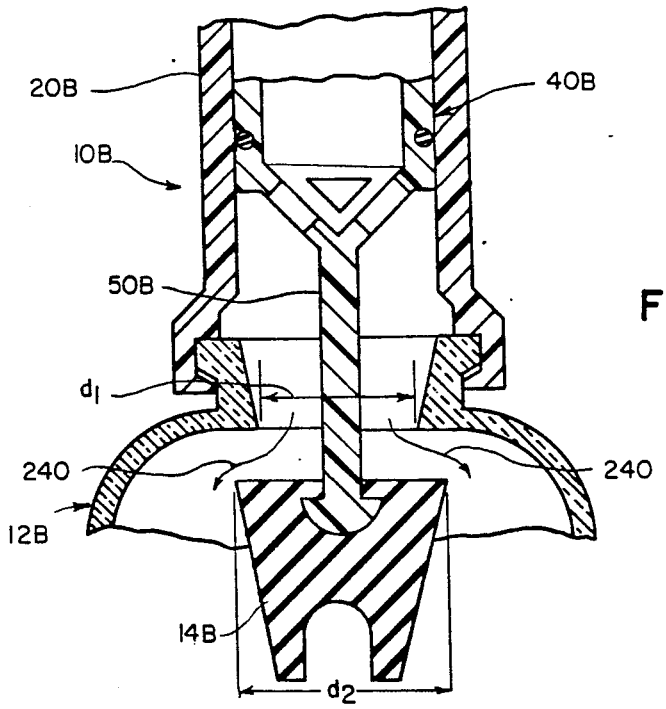
FIG. 6 is an elevational view similar to that of FIG. 5, but demonstrating the unsealed, mixing configuration of the package of FIG. 5.

In the previous embodiments, the plunger has featured a flat surface (44, 44A) bearing on the top of the stopper which surface presses the stopper against its outlet to seal the outlet against leakage. Such embodiments have removed the stopper by pulling it from the outlet. However, the sealing pressure need not come from just a flat surface bearing on the top of the stopper nor need removal occur by pulling. An alternative is shown in FIGS. 5 and 6, wherein parts similar to those previously described bear the same reference numeral to which the distinguishing suffix "B" has been appended.

Thus, package 10B comprises both lower portion 12B that is preferably a bottle, an upper portion comprising sleeve 20B and plunger 40B, and a stopper 14B inserted into outlet 16B of bottle 12B. Liquid L is preferably stored in the upper portion, to be used to reconstitute the lyophilate (not shown) in bottle 12B. However, unlike previous embodiments, the upper portion 26B of stopper 14B has no lip to rest on the top of outlet 16B. Instead, both bottom portion 18B of the stopper, and outlet 16B, are of matched conical shape, tapering downwardly towards an imaginary point p, FIG. 5, so that the further the stopper is inserted, the more it seals against outlet 16B. In turn, end 41B of plunger 40B has no disk, as before, and instead comprises only stud 50B, which now is greatly elongated, FIG. 6, to allow stud 50B to be inserted later all the way through outlet 16B. (Stud 50B has a nail-head shape as before, to engage recess 32B.) The outer diameter $d_2$ of upper stopper portion 26B is considerably greater, in its uncompressed shape, than is the inner diameter $d_1$ of outlet 16B, FIG. 6. The effect of stud 50B being pushed downward, arrow 220, is to generate forces $F_1$ perpendicular to the surface of outlet 16B, thus sealing the stopper, FIG. 5.

In such a construction, the outer surface of top portion 36B of stopper 14B is, of course, exposed to liquid L, so that the entire surface 36B, as well as the sides 230 adjacent thereto, should be protectively coated with Teflon.

Removal of the stopper to allow reconstitution can be done two ways: plunger 40B :an be unscrewed to pull the stopper upward and out of bottle 12B, as before. Alternatively, however, by constructing stopper 14B from sufficiently compressible material, stopper 14B can be unseated by advancing stud 50B and the stopper all the way through aperture 16B, FIG. 6, into the bottle 12B. Liquid L then flows down to contact the lyophilate, arrows 240.

The invention has been described in detail with particular reference to preferred embodiments thereof, but it will be understood that variations and modifications can be effected within the spirit and scope of the invention.

What is claimed is:

1. In a bottle package containing a first material in a first portion, a second material in a second portion for mixing with said first material after storage, and a barrier between said portions for maintaining the materials temporarily separate from each other, one of said portions comprising a bottle;

the improvement wherein each said portion has an outlet capable of providing material access to said other portion, and said barrier comprises a stopper in each of said outlets, the stopper in said first portion being susceptible to leaching in the presence of the second material and the stopper in said second portion being effective to seal off the second material from access to said outlets and said stopper in said first portion, and a plunger extending from and movably mounted in said second portion, said plunger having means for permanently attaching both of said stoppers and means for sealing at least one of said stoppers to the outlet receiving said stopper of said first portion, said plunger including means for manual engagement to allow said stoppers to be pulled away from said outlets, whereby the second material can be added to the first material after storage is no longer needed.

2. A bottle package as defined in claim 1, wherein said plunger is hollow and includes two opposite ends, one of said ends terminating in said second stopper and the other of said ends being blocked by a removable closure member, whereby a mixture of the two materials can be poured out of the bottle by removing said closure member.

3. A bottle package as defined in claim 1, wherein said plunger engages said second portion by a screw thread, whereby said stoppers are removed by unscrewing said plunger.

4. A bottle package as defined in claim 3, wherein said screw thread is an integral part of the inside surface of said second portion, whereby said plunger is in contact with said second portion while sealing the second material from said access, and while removing said stoppers by said unscrewing.

5. A kit for sealing a lyophilizing bottle having an opening using an elastomeric stopper for insertion into said bottle to close said opening, the kit comprising (a) a sleeve constructed to fit around said stopper and said opening, (b) a plunger movably mounted within and in contact with said sleeve and extending therefrom, said plunger having opposite ends, one of said ends including means for joining said stopper to said plunger and the other end including a removable closure member, said one stopper end further including means for pressing said elastomeric stopper against said opening to seal it, and (c) means for moving said plunger with a mechanical advantage down through and in contact with said sleeve to contact said elastomeric stopper with said pressing means.

6. A kit as defined in claim 5, wherein said moving means comprise a handle on said plunger, and a screw thread engagement between said plunger and said sleeve.

7. A kit as defined in claim 5, wherein said means for pressing comprises a second stopper constructed to seal against said sleeve to temporarily prevent any material contained in said sleeve, from contacting said elastomeric stopper.

* * * * *